United States Patent [19]

Peterson et al.

[11] Patent Number: 4,484,600

[45] Date of Patent: Nov. 27, 1984

[54] SWIVEL SPOUT CONSTRUCTION FOR A FAUCET

[75] Inventors: Donald W. Peterson, Fairview Park; Susan K. Nimon, Cleveland, both of Ohio

[73] Assignee: Streamway Corporation, Middleburgh Heights, Ohio

[21] Appl. No.: 343,208

[22] Filed: Jan. 27, 1982

[51] Int. Cl.[3] ..... E03C 1/04

[52] U.S. Cl. ..... 137/801; 137/606; 4/192; 138/163; 285/374; 285/388

[58] Field of Search ..... 137/801, 606, 111; 285/374; 138/157, 171, 156, 163; 4/192

[56] References Cited

U.S. PATENT DOCUMENTS

| | | | |
|---|---|---|---|
| 1,859,864 | 5/1932 | Christie | 138/157 |
| 2,134,966 | 11/1938 | Boscow et al. | 137/606 |
| 2,585,997 | 2/1952 | Bruewer | 137/801 |
| 2,781,786 | 2/1957 | Young | 138/64 |
| 2,795,844 | 6/1957 | Liszak | 29/458 |
| 3,013,925 | 12/1961 | Larsen | 156/153 |
| 3,448,768 | 6/1969 | Keller | 4/192 |
| 3,590,876 | 7/1971 | Young | 137/801 |
| 3,630,223 | 12/1971 | Schaverien | 137/327 |
| 3,796,380 | 3/1974 | Johnson et al. | 239/590.5 |
| 3,871,406 | 3/1975 | Anderson | 137/801 |
| 4,026,328 | 5/1977 | Nelson | 137/801 |

FOREIGN PATENT DOCUMENTS

| | | | |
|---|---|---|---|
| 909956 | 4/1954 | Fed. Rep. of Germany | 138/157 |
| 12903 | of 1895 | United Kingdom | 138/157 |
| 907541 | 10/1962 | United Kingdom | 4/192 |
| 1277202 | 6/1972 | United Kingdom | 137/801 |

*Primary Examiner*—Samuel Scott
*Assistant Examiner*—Allen J. Flanigan
*Attorney, Agent, or Firm*—Fay & Sharpe

[57] ABSTRACT

A swivel spout construction for a faucet in which there is provided a composite spout defined by an elongated generally U-shaped shell and an elongated plate both molded from plastic material. The shell and plate define sealing flanges which are secured together by means of hot plate welding. The shell and plate together define end walls, sidewalls and an upper and bottom wall which form a waterway. A hollow, cylindrical spud extends from the bottom of the plate at the spout inlet and is retained in a cylindrical bore of the faucet underbody by means of a retaining ring and a hold down nut. The construction provides for a swivel spout which is suitable for kitchen use under relatively high hydrostatic pressures and with a capability to withstand water hammer and shock pressures generated by the opening and closing of a dishwasher inlet valve. The composite spout provides for a low cost esthetically pleasing design that has relative ease of manufacture as compared to other designs.

14 Claims, 12 Drawing Figures

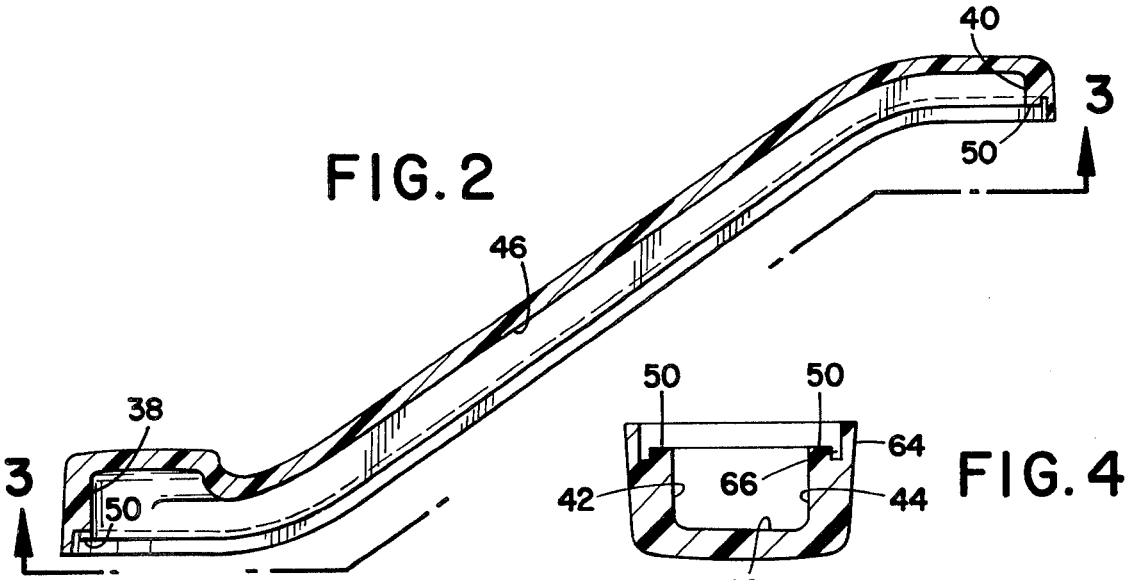
FIG. 2
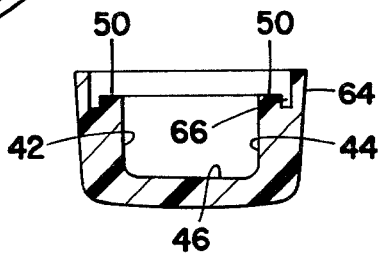
FIG. 4
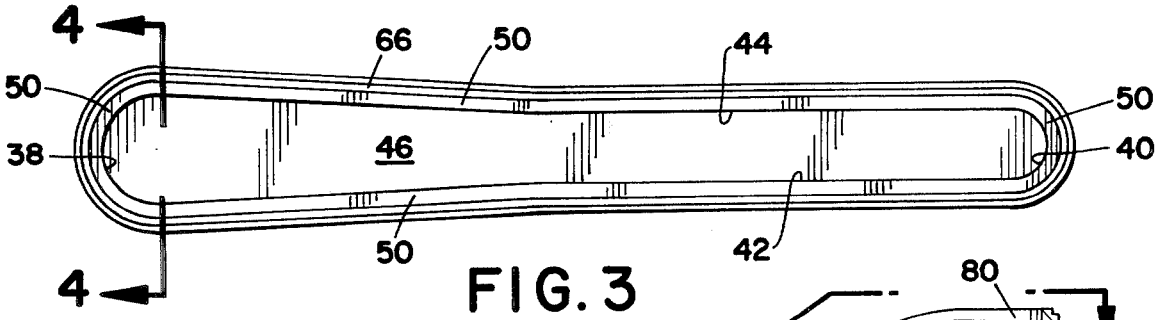
FIG. 3
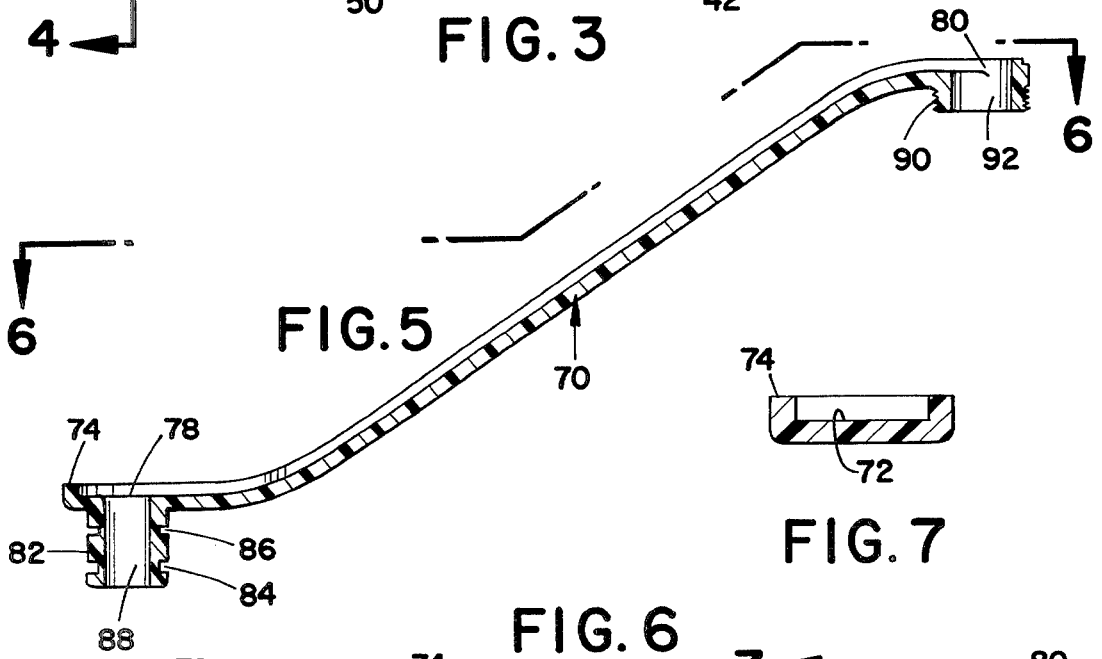
FIG. 5
FIG. 7
FIG. 6
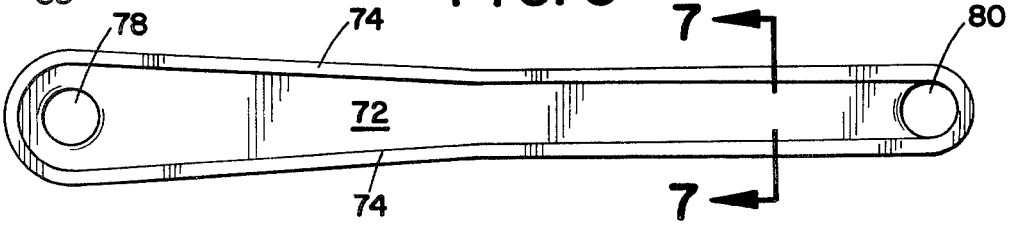

SWIVEL SPOUT CONSTRUCTION FOR A FAUCET

BACKGROUND OF THE INVENTION

This invention relates to a swivel spout construction for a faucet or the like commonly found in a kitchen.

A kitchen faucet presents design considerations more demanding than are found in other fixtures such as bathroom fixtures. In this regard, a kitchen faucet must swivel in order to provide for a discharge of water at various locations of the sink. A kitchen faucet may also be used in connection with the operation of a portable dishwasher. In this instance, the inlet hose from the dishwasher is connected directly to the kitchen faucet. As a consequence, the opening and closing of the inlet valve of the dishwasher subjects the spout of the faucet to water hammer or severe shock pressures which act on the faucet and, over a period of time, can have a deteriorating effect on the faucet. A kitchen faucet must, in addition, be able to withstand relatively high hydrostatic pressure particularly because of the demands imposed by the operation of a portable dishwasher which may be connected to the spout of the faucet. Still further, a kitchen faucet must be impact resistant and must be noncorrosive. Finally, a kitchen faucet must be esthetically pleasing and have a design that compliments other appliances and fixtures in the kitchen and the home.

While all of the design considerations reviewed above can be met in a kitchen faucet of conventional design, the resulting faucet is, in most cases, high priced and relatively difficult to manufacture. The concept of a low cost kitchen faucet that will meet the stringent design requirements set forth above has, heretofore, been thought impossible to achieve.

The subject of this application is a relatively low cost, esthetically pleasing swivel spout construction suitable for use in an environment requiring relatively high hydrostatic pressures, water hammer and shock pressures imposed by the opening and closing of a dishwasher valve in a portable dishwasher, and a swivel interconnection between the faucet spout and the faucet underbody which is durable and reliable. Applicant's swivel spout construction is fabricated entirely from plastic which is noncorrosive, has relatively high impact resistance and can be manufactured in a relatively low cost operation.

BRIEF DESCRIPTION OF THE INVENTION

Briefly described, applicant's invention is directed to a swivel spout construction for a faucet and the like. A composite spout is interconnected to a faucet underbody by means of a hold down nut which contacts a retaining ring of the spout. The spout is fabricated from a molded plastic shell and a molded plate which are welded together in a hot plate welding process. The shell is generally U-shaped in section defining end walls, sidewalls and an upper wall. A shell sealing flange forms a closed loop. The molded plate defines a bottom wall and a plate sealing flange which is contiguous with the shell sealing flange and is sealed thereto by means of the just-mentioned hot plate welding process. The respective end walls, sidewalls and upper and bottom walls define a waterway. An inlet aperture is defined in the plate, as well as an outlet. A hollow, cylindrical spud is integral with the plate and extends from the bottom wall of the plate. A retaining ring groove is defined in the spud along with an O-ring seal groove.

The spud and retaining ring are adapted to be received within a cylindrical bore defined by the faucet underbody. A swivel interconnection between the composite spout and the faucet underbody is provided by means of a hold down nut which is threadedly attached to the faucet underbody and which engages the retaining ring of the spud.

The composite spout construction just described affords an esthetically pleasing, relatively low cost faucet construction making it possible to utilize "high style" design in a relatively low cost faucet in the demanding environment of a kitchen. Applicant's construction withstands the relatively high hydrostatic pressures encountered in the kitchen along with the water hammer or shock pressures imposed on the spout by a portable dishwasher.

The spout of this invention, which utilizes welded together plate and shell members, provides for a water passageway without the necessity of an internal water passage common to many prior art designs. The spout of this invention is noncorrosive and has relatively high impact resistance.

DESCRIPTION OF THE PREFERRED EMBODIMENT

The preferred embodiment of applicant's invention will now be described with reference to the accompanying drawings in which:

FIG. 2 is a side cross-sectional view of the shell of the preferred embodiment of applicant's composite spout;

FIG. 3 is a bottom elevational view taken along the lines 3—3 of FIG. 2;

FIG. 4 is a cross-sectional view taken along the lines 4—4 of FIG. 3;

FIG. 5 is a side cross-sectional view of the plate of the preferred embodiment of applicant's composite spout;

FIG. 6 is a top elevational view taken along lines 6—6 of FIG. 5;

FIG. 7 is a cross-sectional view taken along the lines 7—7 of FIG. 6;

Figures 1, 1A:
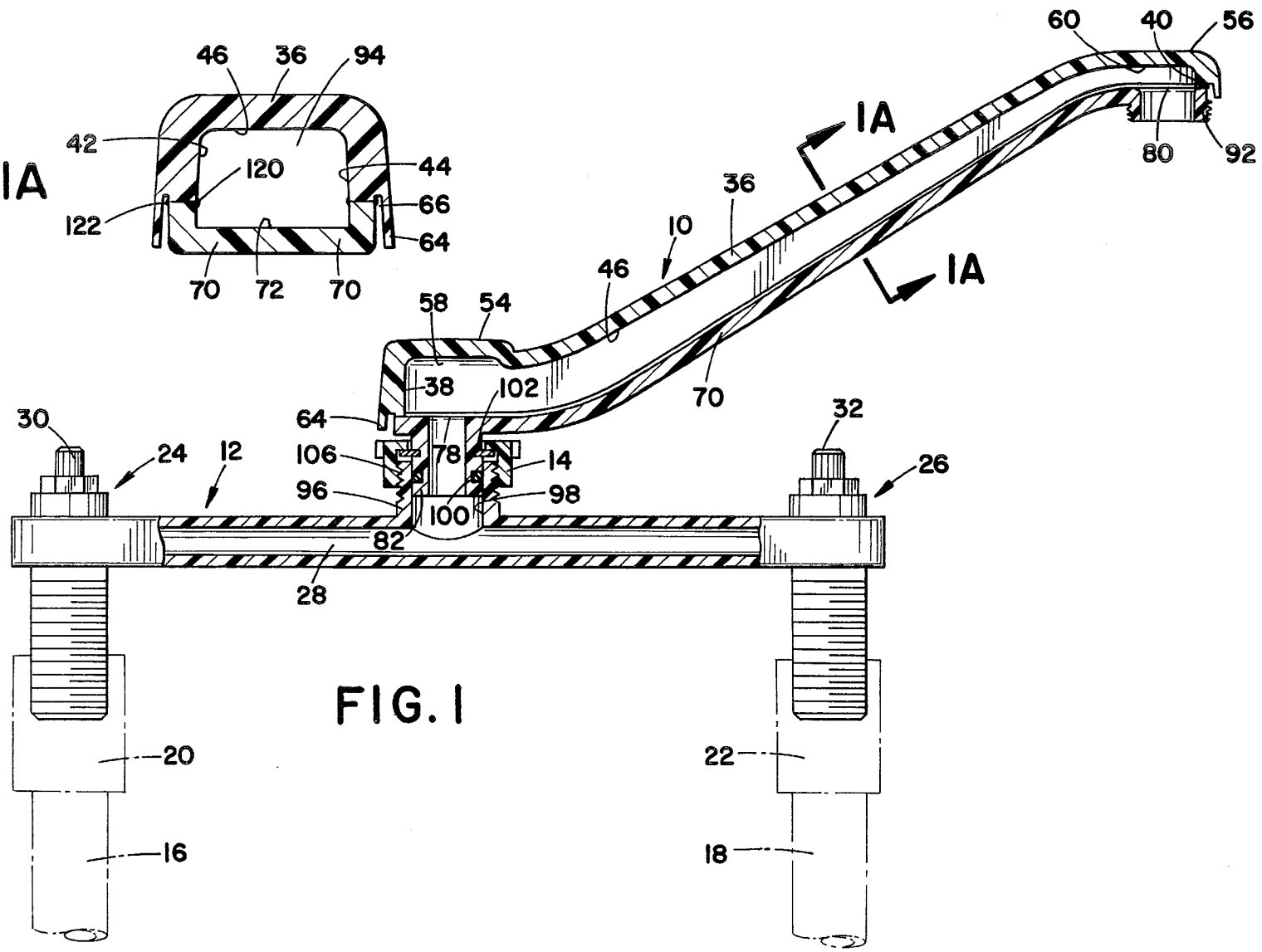
FIG. 1 is a front elevational view, partly in section, and showing the preferred embodiment of applicant's swivel spout construction in a kitchen or deck-type faucet.
FIG. 1A is a cross-sectional view taken along the lines 1A—1A of FIG. 1.

Attention will first be directed to FIG. 1 wherein there is shown a cross-sectional view of applicant's swivel spout construction as embodied in a kitchen or deck-type faucet. The basic elements of the faucet construction shown in FIG. 1 include a swivel spout 10 which is interconnected to a faucet underbody 12 by means of a hold-down nut 14. A hot water line 16 and a cold water line 18 are respectively interconnected to the faucet underbody 12 by means of coupling nuts shown schematically at 20, 22. A hot water valve 24 and a cold water valve 26 are provided at the faucet underbody for the purpose of admitting hot and cold water into fluid passageway 28. For ease of description, the operating handles for the valves 24, 26 have been omitted from FIG. 1. It should be understood, however, that the respective handles are interconnected to the valve stems 30, 32 in order to provide for turning of the valve stems to control the flow of water through the respective valves.

The composite faucet spout as shown in FIG. 1 is defined by an elongated generally U-shaped shell 36 which, with reference to FIGS. 1, 1A, 2, 3 and 4 has end walls 38, 40, sidewalls 42, 44 and upper wall 46. As best seen in FIGS. 3 and 4, a shell sealing flange 50 is defined adjacent the end walls 38, 40 and sidewalls 42, 44. Shell sealing flange 50 forms a closed loop as shown in FIG. 3 which extends generally around the periphery of the shell. As best seen in FIG. 4, the shell sealing flange 50 is generally normal to the sidewalls 42, 44. Similarly, flange 50 is normal to the end wa11s 38, 40 as best seen in FIG. 2.

Again with reference to FIG. 1, it may be seen that the side profile of shell 36 is generally elongated, defining an esthetically pleasing configuration that might be characterized as a flattened "S" design. In this regard, it is to be noted that the upper surface portion 54 of shell 36 is approximately parallel to the upper surface portion 56. The internal surface portion 58 is, similarly, substantially parallel to the internal surface portion 60 although, as will be observed in FIG. 1, portion 58 is somewhat relieved or inset with respect to the surface of upper wall 46.

As best seen in FIG. 4, shell 36 includes a skirt portion 64 which is positioned substantially adjacent the shell sealing flange 50 and is approximately parallel to the end walls 38, 40 and sidewalls 42, 44. A slight recess 66 is defined between skirt portion 64 and shell sealing flange 50 for a purpose to be described further below in connection with the manufacture of applicant's composite spout.

Turning back to FIG. 1, applicant's composite spout includes, in addition to shell 36, an elongated plate 70. As best seen in FIGS. 5, 6 and 7, plate 70 has a bottom wall 72 and a plate sealing flange 74 which, like shell sealing flange 50, defines a closed loop extending substantially around the periphery of the plate.

An inlet aperture 78 and an outlet aperture 80 are defined at each end of plate 70 as best seen in FIGS. 5 and 6. Inlet aperture 78 affords entry of water into the passageway defined by the shell 36 and plate 70 whereas outlet aperture 80 affords discharge of water from the interior of the composite spout.

A hollow cylindrical spud 82 is molded integral with the plate 70 and extends downwardly from the bottom wall as best seen in FIG. 5. Spud 82 includes an O-ring receiving groove 84 and a retaining ring groove 86. The interior passageway 88 of spud 82 communicates with inlet aperture 78 to provide for the entry of fluid into the interior of the composite spout.

At the discharge end of the spout there is defined by plate 70 integral threads 90 defined on boss 92 which extends from plate 70. An aerator is threadedly attached to boss 92 at threads 90 for the purpose of providing for air entrainment in the water as it is discharged from the spout. For ease of description, the aerator has been omitted from the FIGURES of this application. It forms no part of the invention.

When the shell 36 and plate 70 are interconnected, in the manner to be described below, there is defined an internal waterway 94 (FIG. 1A) which is defined by the end walls, sidewalls 42, 44, upper wall 46 and bottom wall 72 of the respective shell 36 and plate 70. The waterway 94 is completely closed with the exception of the inlet aperture 78 and the outlet aperture 80.

The swivel interconnection between the composite spout and the faucet underbody is shown in FIG. 1. The faucet underbody 12 includes an upstanding portion 96 which defines a cylindrical bore 98 for the purpose of receiving spud 82. An O-ring 100 is disposed within groove 84 of spud 82 for the purpose of affording sealing between the spud and the cylindrical bore. Retention of the spud in the bore is afforded by means of a retaining ring 102 which, in the preferred embodiment, is a split ring received within groove 86 of spud 82. A hold down nut 14 is adapted to be threadedly received about Q upstanding portion 96 at threads 106. As shown in FIG. 1, when abutting contact is made between hold down nut 14 and retaining ring 102, withdrawal of the spud 82 from cylindrical bore 98 is prevented.

The interconnection between the composite spout 10 and faucet underbody 12 of FIG. 1 affords a sealed joint between these structures with the capability of 360 degree rotation of the spout relative to the faucet underbody.

ASSEMBLY

The manner of assembly of plate 70 to shell 36 will now be described with reference to FIGS. 8–11.

In the preferred embodiment, applicant utilizes a hot plate welding technique for the purposes of heating the sealing flanges 50, 74 of the respective shell and plate and, thereafter, bringing the heated flanges into contact with one another where welding is accomplished as the members cool.

Figure 8:
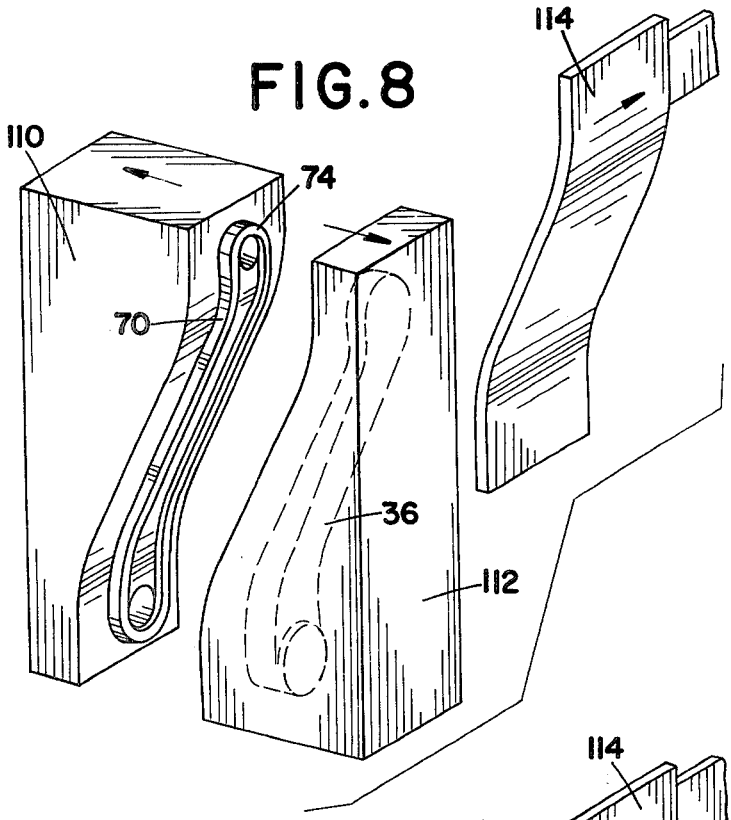
FIGS. 8–11 are sequential views showing the manner of hot plate welding of the shell and plate of applicant's composite spout.

With reference to FIG. 8, it will be observed that a pair of fixtures 110, 112 are utilized to retain the plate and shell in generally upright positions. In FIG. 8, the fixture 110 retains plate 70 in an upright position so that sealing flange 74 is directed outwardly of the fixture. Similarly, fixture 112 retains shell 36 so that its respective sealing flange 50 (not shown) is directed outwardly of the fixture toward plate 70.

The welding apparatus of FIG. 8 includes a hot plate 114 which is adapted to be moved into a position between the fixtures 110, 112. Hot plate 114 is configured to be essentially complimentary to the shape of shell 36 and plate 70 so that, when heated, plate 114 provides a source of heat to melt the respective sealing flanges 50, 74 of the shell and plate.

Figure 9:
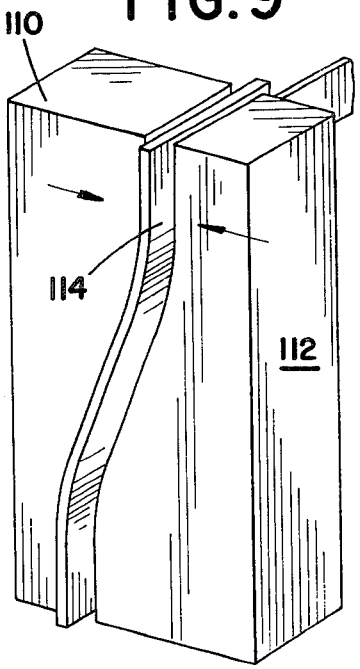

In FIG. 9 the hot plate 114 is shown in position between the fixtures 110, 112 and the said fixtures have been brought toward one another so that contact of the plate 114 with the respective flanges may be made.

Figure 10:
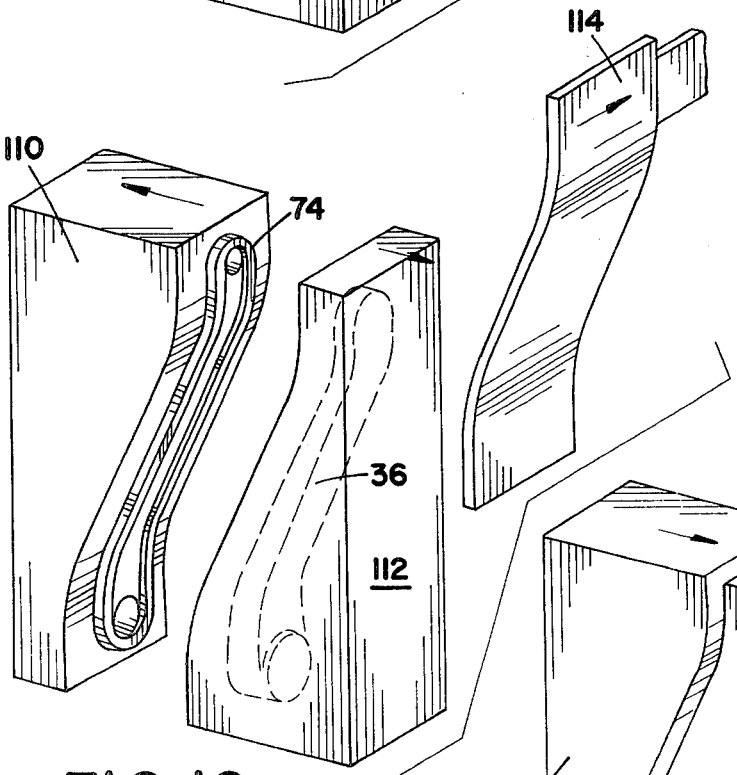
Figure 11:
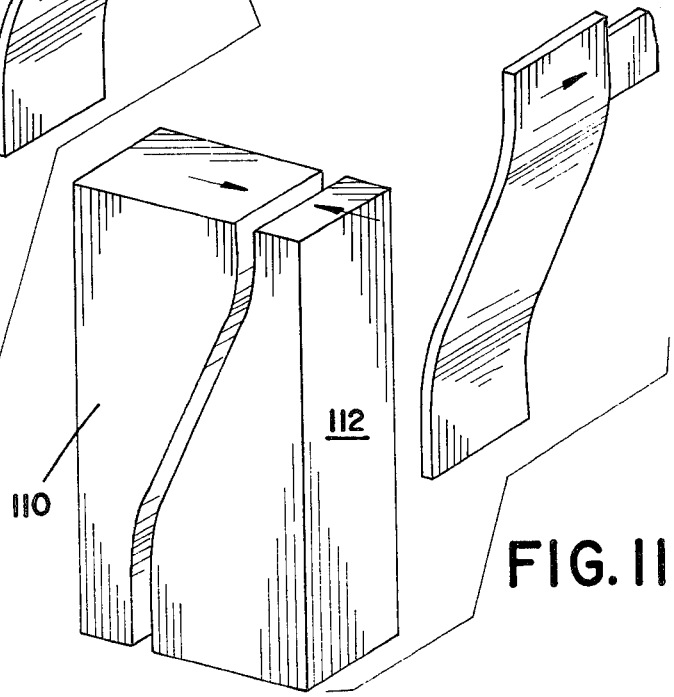

In FIG. 10, the respective fixtures 110, 112 are shown in a separated condition with the plate 114 withdrawn. It should be understood that in the configuration of FIG. 10, the respective sealing flanges 50, 74 have been melted and are ready to be joined together. Joining of the respective flanges is accomplished in FIG. 11 wherein the respective fixtures 110, 112 are brought together so as to bring into contact the respective sealing flanges 50, 74 of the shell 36 and plate 70. After the sealing flanges have had an opportunity to cool, the fixtures are again separated and the composite spout is removed for further assembly operations.

It will be seen in FIG. 1A that the hot plate welding operation just described produces a slight internal bead 120 at the interior of the composite spout. Similarly, a slight external bead 122 is defined in the welding operation. The recess 66 previously described in connection with shell 36 affords a convenient relief passage for bead 122. At the same time, skirt portion 64 provides a shield or cover for bead 122 making the overall composite spout design esthetically pleasing.

As a further aspect of the esthetics of the construction of this invention, it will be noted in FIG. 1A that the skirt portion 64 has a height which is approximately equal to the thickness of plate 70. As a consequence, when the welding operation is completed, the composite spout takes the appearance of a one-piece construction of "high style" design.

ADVANTAGES OF THE INVENTION

It can be appreciated from the description of the invention that it is possible to manufacture a stylish and pleasing spout at a relatively low cost and yet have the durability and capability of more expensive spouts.

The two-piece construction of the composite spout makes the manufacture of a designer spout possible in a relatively straightforward and low cost manner.

The manner of assembly utilizing hot plate welding produces a spout construction that is capable of withstanding relatively high hydrostatic pressures imposed on the spout when, for example, it is connected to a portable dishwasher. When a portable dishwasher is used in conjunction with a kitchen faucet, the inlet hose to the dishwasher is ordinarily interconnected into the faucet at the boss 92 (FIG. 1) at the faucet outlet. The faucet is then turned to a full open position in order to pressurize the inlet hose to the dishwasher. The control of water flow into the dishwasher is brought about by means of actuation of the dishwasher inlet valve which is located in the dishwasher downstream of the faucet spout. As a consequence, the faucet spout is pressurized with line pressure for relatively long periods of time during dishwasher operation. Line pressure is normally approximately 80 psi. The faucet of this invention withstands several times that pressure due to several design features of the faucet which will now be described.

The first design feature contributing to increased hydrostatic pressure tolerance is the fact that the waterway 94 (FIG. 1A) is defined by a shell 36 and plate 70 which have substantial wall thickness.

A second design consideration is the fact that the shell 36 and plate 70 are welded together in a hot plate welding operation which produces a secure weld between the members as shown at 120, 122 of FIG. 1A.

A third design consideration contributing to higher strength is the fact that the aerator boss 92 is molded integral with the plate 70 eliminating what is sometimes a separate interconnection between the aerator, an aerator collar, and the spout.

A fourth design consideration contributing to increased strength is the provision of a spud 82 which is molded integral with the plate 70. Here again, what has sometimes been a separate interconnection between the spud and the spout has been eliminated in the composite spout of this invention as the plate 70 is defined by an integral spud which provides for an inlet passage 88 into the composite spout without the necessity of separate sealing.

All of the design considerations just-mentioned contribute to the fact that the composite faucet of this invention is capable of withstanding hydrostatic pressure limits considerably in excess of pressures normally encountered in regular operation.

In addition to withstanding hydrostatic pressure, a kitchen faucet must also be capable of resisting water hammer or shock pressures imposed in the line by virtue of the opening and closing of a solenoid operated inlet valve at a dishwasher.

As has been previously addressed above in connection with hydrostatic pressure, the attachment of an inlet hose from a dishwasher to the faucet spout of a kitchen faucet brings the spout into proximity to the solenoid operated inlet valve at the dishwasher. Opening and closing of the inlet valve at the dishwasher produces abrupt changes in flow of water through the dishwasher inlet hose and, correspondingly, through the faucet spout. Such abrupt changes in flow produce what is termed "water hammer" which is a shock pressure pulsation over a short period of time which passes through the water line. Water hammer pulsations not only produce noise but can damage plumbing as, for example, when a water line is literally torn from its support or, alternately, a faucet or valve is caused to fail. Because of the design considerations discussed above (increased wall thickness, hot plate welding between the shell and plate, integral aerator attachment at the plate and integral spud attachment at the plate) the composite spout of this invention has been found suitable for use in the most demanding environments.

A further design advantage is the fact that the composite spout of this invention is resistant to impact. Several design considerations produce impact resistance. The inverted U-shape of the shell 36 imparts a great deal of rigidity and impact resistance to the spout. In addition, the use of an integral spud 82 which is molded into the plate 70 for the swivel interconnection of the spud to the faucet underbody eliminates excessive wobble in the faucet which is prevalent in tube spouts and regular brass spouts.

A further advantage of the spout of this invention is the fact that it is noncorrosive, being fabricated entirely from plastic. In the preferred embodiment, the plastic material is ABS.

The design of this invention makes it possible to use standard conventional aerators or end trim.

The two-piece welding concept of this invention totally eliminates the need for an internal water passage or a separate internal conduit which is characteristic of many prior art designs. A single wall construction defines both the outer surface of the spout and the internal waterway of the spout. The use of double walls or the use of an internal water passage with an outer decorative plate has been eliminated.

The spout of this invention can be molded of colored plastic or, alternately, can be electroplated with a chrome or other surface finish.

ALTERNATE EMBODIMENTS OF THE INVENTION

Alternate embodiments of the invention are contemplated and should be considered within the spirit thereof.

While the preferred embodiment of applicant's composite spout is fabricated in a hot plate welding operation, it should be understood that other techniques and means for securing the respective shell sealing flange 50 and plate sealing flange 74 together are possible. Thus, the use of adhesives, and other joining techniques including mechanical fasteners should be considered within the spirit and scope of this invention.

While the preferred embodiment of the invention has been described with reference to a composite spout having the design characteristic of a flattened "S" design, it should be appreciated that other designs are equally applicable to the principles of the invention. That is to say, the composite spout may be designed to other shapes and configurations including those which have a substantially U-shaped configuration, an "S" shaped configuration, and other configurations desirable for use with a kitchen or lavatory sink.

While the preferred embodiment of the invention has been described with reference to a kitchen or deck-type faucet, this has been done because the kitchen or deck-type faucet normally encounters more severe use than other faucets. The invention, however, should not be considered as limited to a kitchen or deck-type faucet since it has application to faucets generally including those used in the home and those that are used in industry.

In the preferred embodiment of the invention, ABS material has been described by applicant as the material of choice. It should be understood that other plastic material may be used. Indeed, materials other than plastic may be used.

Finally, it should be noted that whereas in the preferred embodiment the composite spout is defined by a generally U-shaped shell member which is secured to a pate member with the area of joinder being located at essentially the under surface of the spout, other designs are possible. For example, with reference to FIG. 1, the shell 36 is shown, in the preferred embodiment, as being located generally above the plate 70. In alternate embodiments, the plate 70 may define the upper wall of the spout and the shell 36 may define the bottom wall of the spout with the cylindrical spud being molded to the shell in lieu of the plate. In a still further modification of the invention, the shell 70 could be used to define a sidewall in the composite spout with the shell 36 defining the opposite sidewall as well as the upper and bottom walls. A number of design variations are, thus, possible and should be considered within the spirit of the invention.

Although the invention has been shown and described with reference to preferred and alternate embodiments, it is obvious that modifications and alterations will occur to others upon a reading and understanding of this specification. It is intended to include all such modifications and alterations insofar as they come within the scope of the amended claims or the equivalents thereof.

What is claimed is:

1. A swivel spout construction for a faucet and the like comprising in combination:

a composite spout, said spout defined by an elongated generally U-shaped shell having end walls, sidewalls and an upper wall and a shell sealing flange, said shell sealing flange forming a closed loop;

an elongated plate having a bottom wall and a plate sealing flange which is contiguous with said shell sealing flange and in sealing engagement therewith;

said shell further including a skirt portion surrounding and overhanging said shell sealing flange, wherein a recess is formed between said skirt portion and said shell sealing flange, said recess adapted to receive any excess material resulting from the bonding of said shell sealing flange to said plate sealing flange;

said end walls, sidewalls and upper and bottom walls defining a waterway;

inlet aperture means and outlet aperture means at respective ends of said plate to facilitate the entry and discharge of water into and out of said waterway;

a hollow cylindrical spud integral with said plate and extending from said bottom wall of said plate at said inlet aperture means, said spud having a retaining ring groove in the external surface thereof;

a retaining ring received in said groove;

a faucet underbody having means to receive hot and cold water and a cylindrical bore for receiving said spud;

sealing means between said bore and said spud; and, retaining means for engaging said ring and for securing said spud to said faucet underbody.

2. The invention of claim 1 in which said skirt portion has a height approximately the thickness of said plate.

3. The invention of claim 1 in which said skirt portion is approximately parallel to said end walls and said sidewalls.

4. The invention of claim 1 in which said shell sealing flange is substantially normal to said sidewalls and said end walls.

5. The invention of claim 1 in which said shell and said plate are plastic and have substantial wall thickness for strength.

6. The invention of claim 5 in which sealing engagement between said shell sealing flange and said plate sealing flange is provided by hot plate welding of said flanges together.

7. A high strength non-corroding composite spout for a swivel spout construction for a faucet and the like comprising in combination:

an elongated generally U-shaped plastic shell having end walls, sidewalls and an upper wall and a shell sealing flange, said shell sealing flange forming a closed loop;

an elongated plastic plate having a bottom wall and a plate sealing flange which is contiguous with said shell sealing flange and is heat sealed directly thereto to form a unitary structure with said end walls, side walls and upper and bottom walls defining a waterway, said shell and said plate having substantial wall thickness for strength;

inlet aperture means and outlet aperture means at respective ends of said plate to facilitate the entry and discharge of water into and out of said waterway;

a hollow cylindrical spud integral with said plate and extending from said bottom wall of said plate at said inlet aperture means, said spud having a retaining ring groove in the external surface thereof; and, an aerator boss integral with said plate and extending from said bottom wall of said plate at said outlet aperture means.

8. The invention of claim 7 in which said shell includes a skirt portion extending past said shell sealing flange.

9. The invention of claim 8 in which said skirt portion has a height approximately the thickness of said plate.

10. The invention of claim 8 in which said skirt portion is approximately parallel to said end walls and said sidewalls.

11. The invention of claim 7 in which said shell sealing flange is substantially normal to said sidewalls and said end walls.

12. The invention of claim 7 in which sealing engagement between said shell sealing flange and said plate sealing flange is provided by hot plate welding of said flanges together.

13. The invention of claim 1 further comprising an aerator boss integral with said plate and extending from said bottom wall of said plate at said outlet aperture means.

14. The invention of claim 13 wherein said aerator boss is provided with external threads.

* * * * *